US005649842A

United States Patent [19]

Ohsumi

[11] Patent Number: 5,649,842

[45] Date of Patent: Jul. 22, 1997

[54] TERMINAL STRUCTURE

[75] Inventor: Hideki Ohsumi, Shizuoka-ken, Japan

[73] Assignee: Yazaki Corporation, Tokyo, Japan

[21] Appl. No.: 360,022

[22] Filed: Dec. 20, 1994

[30] Foreign Application Priority Data

Dec. 28, 1993 [JP] Japan ..... 5-334717

[51] Int. Cl.[6] ..... H01R 15/10

[52] U.S. Cl. ..... 439/858; 439/852

[58] Field of Search ..... 439/851–852, 439/858, 861, 884

[56] References Cited

U.S. PATENT DOCUMENTS

| | | | |
|---|---|---|---|
| 4,030,804 | 6/1977 | Enomoto | 439/852 |
| 4,764,133 | 8/1988 | Kaneko | 439/884 |
| 4,909,762 | 3/1990 | Yagi et al. | 439/852 |
| 4,919,628 | 4/1990 | Mobley et al. | 439/852 |
| 4,979,915 | 12/1990 | Pitts | 439/884 |
| 4,992,064 | 2/1991 | Steinhardt et al. | 439/884 |
| 5,073,132 | 12/1991 | Nottrott | 439/884 |
| 5,106,329 | 4/1992 | Maeshima et al. | 439/851 |
| 5,112,254 | 5/1992 | Endo | 439/852 |
| 5,281,178 | 1/1994 | Biscorner | 439/851 |

FOREIGN PATENT DOCUMENTS

| | | |
|---|---|---|
| 60-109274 | 7/1985 | Japan . |
| 2-5271 | 1/1990 | Japan . |

*Primary Examiner*—David L. Pirlot
*Assistant Examiner*—Brian J. Biggi
*Attorney, Agent, or Firm*—Wigman, Cohen, Leitner & Myers, P.C.

[57] ABSTRACT

A terminal structure includes a male terminal which is formed by folding a piece of plate material and a female terminal into which the male terminal is inserted for an electrical connection therebetween. The male terminal has a rod-shaped electrical connection part formed on an end thereof. The electrical connection part is provided on an upper surface thereof with raised portions which are brought into contact with the female terminal when the male terminal is inserted thereinto. The female terminal is formed by folding a piece of plate material. The female terminal is provided inside thereof with a plane upper surface for depressing the male terminal and is also provided with a resilient tongue piece for supporting the male terminal from below. Due to provision of the raised portions on the male terminal, the contacting area between the male terminal and the plane upper surface of the female terminal is reduced to obtain a terminal structure requiring low insertion force. Further, due to elimination of the conventional projections from the inside upper surface of the female terminal, it can be formed so as to have a total height shorter than that of the conventional female terminal.

24 Claims, 2 Drawing Sheets

TERMINAL STRUCTURE

BACKGROUND OF THE INVENTION

The present invention relates to a terminal structure for allowing a male terminal to be inserted into a female terminal with a low insertion force while the electrical connection therebetween can be ensured.

As a prior art, Japanese Utility Model Publication No.60-109274 discloses a terminal structure which consists of a male terminal and a female terminal into which the male terminal is inserted. In this conventional structure, the female terminal, which can be obtained by bending a plate material, is shaped to form a casing. Inside the casing, two projections are formed on a substantially plane upper surface of the casing to depress the male terminal. The projections are arranged in parallel with each other to extend along the longitudinal direction of the female terminal. Provided on an interior downside of the casing is a resilient tongue piece which has a protrusion formed on an upper surface thereof.

On the other hand, the male terminal is also formed by bending a piece of plate material. The male terminal has a rod-shaped electrical connection part formed on one end in the longitudinal direction. This electrical connection part has a cross section defined by substantially plane upper surface and lower surface.

In assembly, the male terminal is inserted into the casing of the female terminal so that the electrical connection part of the male terminal is supported between the inside upper surface of the casing and the resilient tongue piece thereof, so that an electrical connection between the male terminal and the female terminal can be accomplished. In more detail, the electrical connection between the electrical connection part of the male terminal and the female terminal is mainly attained through the intermediary of the projections on the inside upper surface of the female terminal and the protrusion formed on the resilient tongue piece. Such a contacting form serves to reduce the force required in inserting the male terminal into the female terminal due to smallness of the contacting area derived from a provision of the projections.

In the above-mentioned structure, however, the provision of the projections on the inside upper surface of the female terminal causes a height thereof to be increased, so that the female terminal itself becomes large-sized, which is far from the miniaturization of the terminals.

SUMMARY OF THE INVENTION

It is therefore an object of the present invention to provide a terminal structure which can offer a reduction of the height of the female terminal in comparison with that of the above-mentioned terminal structure while allowing the low insertion force in inserting the male terminal into the female terminal.

The objects of the invention described above can be accomplished by a terminal structure comprising:

- a male terminal which is formed by folding a piece of plate material, the male terminal having a rod-shaped electrical connection part formed on an end thereof; and
- a female terminal into which the male terminal is inserted for an electrical connection therebetween, the female terminal being formed by folding a piece of plate material and being provided inside thereof with a plane upper surface to depress the inserted male terminal and provided with a resilient tongue piece for supporting the inserted male terminal from below;

- wherein the male terminal includes locally raised portions arranged on an upper surface of the electrical connection part, the raised portions being brought into contact with the depression part when the male terminal is inserted into the female terminal.

With the above mentioned arrangement, since the male terminal is provided on the upper surface thereof with the raised portions, the contacting area between the male terminal and the plane upper surface of the female terminal is reduced thereby so as to provide a terminal structure which requires a low insertion force when inserting the male terminal into the female terminal. The raised portion can be formed by a modification of folding form of the male terminal. Furthermore, due to an elimination of any projections on the inside upper surface of the female terminal, it can be so formed as to have a total height shorter than that of the conventional female terminal.

In the present invention, preferably, the resilient tongue piece is provided on an upper surface thereof with a protrusion which is brought into contact with the male terminal when it is inserted into the female terminal. Also in this case, due to the protrusion provided on the resilient tongue piece, the contacting area between the male terminal and the female terminal can be further reduced for the above low insertion force.

According to the invention, preferably, the electrical connection part of the male terminal is formed in such a manner that the electrical connection part describe arcs in cross section and that respective apexes of the arcs constitute the raised portions, respectively. With such an arrangement, the raised portions can be formed easily at the same time of forming the electrical connection part.

In the present invention, the electrical connection part may be formed in such a tight manner that no clearance is produced therein. Alternatively, the electrical connection part may be formed to leave a space therein. With such an arrangement, it is possible to reduce a thickness of plate forming the male terminal, and the light weight thereof can be obtained.

Other objects and features of the present invention will become more fully apparent from the following description and appended claims taken in conjunction with the accompanying drawings.

DESCRIPTION OF THE PREFERRED EMBODIMENT

An embodiment of the present invention is now described with reference to the drawings.

Figure 1:
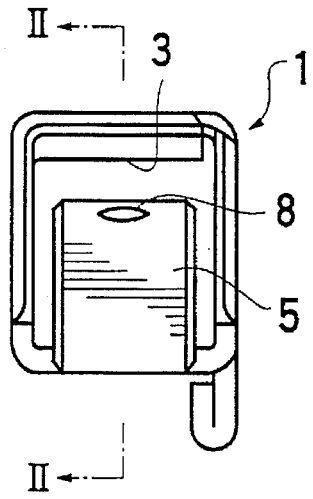
FIG. 1 is a view showing an end of a female terminal constituting a terminal structure in accordance with an embodiment of the present invention.
Figure 2:
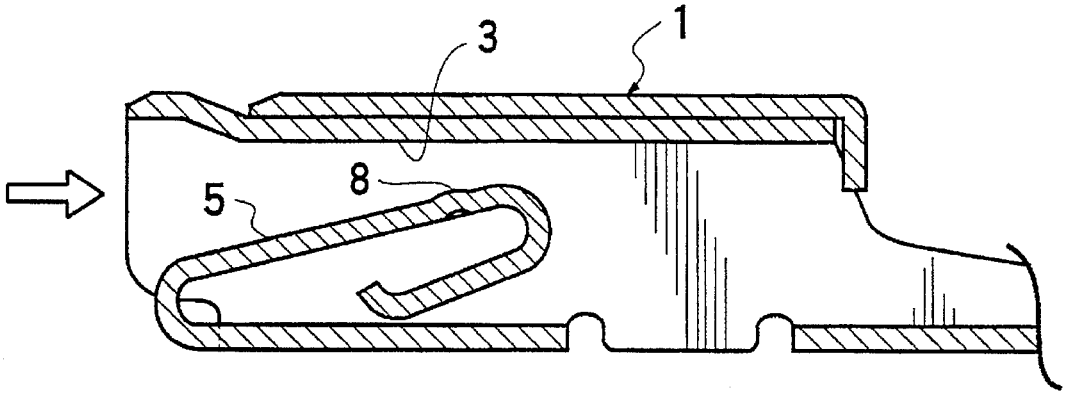
FIG. 2 is a cross sectional view of the female terminal, which is taken along a line II—II of FIG. 1.

Referring to FIG. 1 and FIG. 2, reference numeral 1 designates a female terminal which constitutes a terminal structure of the present invention. Similarly to the conventional female terminal, the female terminal can be formed by bending a plate material so as to be a casing. Inside the female terminal 1, an upper surface 3 thereof is shaped to be substantially plane, providing a part of the female terminal 1 for depressing the male terminal. Different from the conventional female terminal, a projection is not provided on the plane upper surface 3 of the female terminal 1 of the embodiment. Due to this elimination of the projection, the female terminal 1 can be formed to have a total height shorter than that of the conventional female terminal with the projection.

Provided under the plane upper surface 3 of the female terminal 1 is a resilient tongue piece 5 which elastically supports the male terminal inserted into the female terminal 1 from below. The tongue piece 5 has a protrusion 8 formed on an upper surface thereof.

Figure 3:
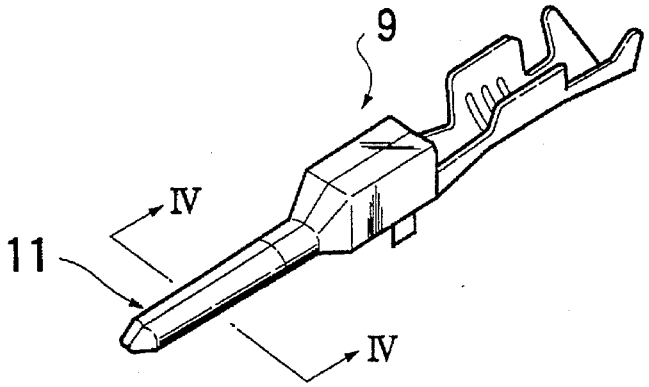
FIG. 3 is a perspective view of a male terminal to be inserted into the female terminal of FIG. 1, which also constitutes the terminal structrure in accordance with the embodiment of the present invention.
Figure 4:
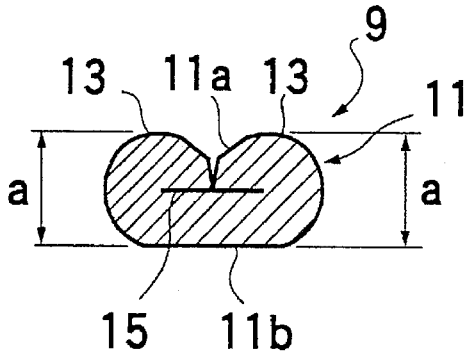
FIG. 4 is a cross sectional view of the male terminal, which is taken along a line IV—IV of FIG. 3.

Referring to FIG. 3, there is shown a male terminal 9 which is also formed by folding a piece of plate material. The male terminal 9 has a rod-shaped electrical connection part 11 formed on one end thereof. FIG. 4 shows a cross section of the electrical connection part 11, taken along a line IV—IV of FIG. 3. As shown in the figure, the electrical connection part 11 is shaped so as to have locally raised portions 13 and 13 on an upper surface 11*a* thereof. In other words, the part 11 is so formed as to describe two arcs in cross section and formed so that respective apexes of the arcs constitute the raised portions 13 and 13, respectively. Such raised portions 13 and 13 can be easily accomplished by modifying the existing folding method which has been applied to form the not-shown conventional connection part. The inside of electrical connection part 11 is constructed to be tight as shown at 15 of FIG. 4, so that no clearance exists therein. Further, the whole height a of the part 11 is established so as to be substantially equal to that of the conventional male terminal.

In assembly, the so-constructed electrical connection part 11 of the male terminal 9 is inserted into the female terminal 1, providing the terminal structure of the present invention. Under such a condition, the upper surface 11*a* of the part 11 locally comes into contact with the plane upper surface 3 of the female terminal 1 at the respective raised portions 13. On the other hand, the lower surface 11*b* locally comes into contact with the resilient tongue piece 5 at the protrusion 8. Therefore, there is not raised any problem in terms of the electrical connection between the female terminal 1 and the male terminal 9.

Furthermore, as described above, since the raised portions 13 are brought into "local" contact with the upper surface 3 of the female terminal 1 in inserting the electrical connection part 11, the contacting area therebetween can be reduced in comparison with that in the case of contacting with planes, so that it is possible to insert the male terminal 9 into the female terminal i with low insertion force, which is similar to that, in the conventional terminal structure, the projections are provided on the upper surface of the female terminal.

According to the embodiment, since the forming of the raised portions 13 can be attained by the modification of folding form of the electrical connection part 11 without providing a particular projection thereon, the production of the male terminal 9 becomes remarkably easy. Further, since a projection is not provided on the upper surface of the female terminal, such an arrangement enables the height of the male terminal to be reduced, whereby the miniaturization of the terminal structure can be enhanced for multi-layered connection of high density while the manufacturing process of the female terminal can be simplified.

Figure 5:
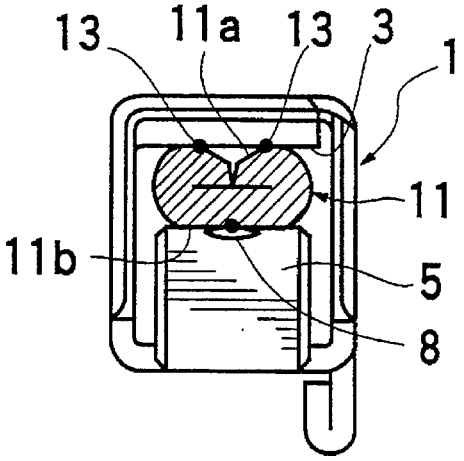
FIG. 5 is a partially cross sectional view showing the end of the female terminal of FIG. 1 into which the male terminal is inserted.
Figure 6:
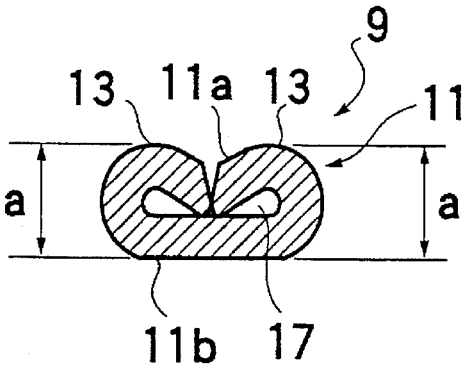
FIG. 6 is a cross sectional view of a male terminal constituting a terminal structure in accordance with another embodiment of the present invention, similar to FIG. 4.

FIG. 5 shows a cross section of a female terminal in accordance with another embodiment of the invention. Note, in the embodiment, elements similar to those in the previous embodiment are indicated with same reference numerals.

In the embodiment, the electrical connection part 11 of the male terminal 9 is made from a plate material of a thickness thinner than that of the plate material shown in FIG. 4. Therefore, a space 17 is left inside the electrical connection part 11. According to the embodiment, due to the reduction of plate thickness, the light weightiness of the male terminal can be improved.

Finally, it will be understood by those skilled in the art that the forgoing description of the preferred embodiments of the disclosed structure, and that various changes and modifications may be made to the present invention without departing from the spirit and scope thereof.

What is claimed is:

1. A terminal structure, comprising:

a male terminal which is formed by folding a piece of plate material, said male terminal having a rod-shaped electrical connection part formed on an end thereof; and a female terminal into which said male terminal is inserted for an electrical connection therebetween, said female terminal being formed by folding a piece of plate material and being provided inside thereof with a plane upper surface to depress said male terminal inserted, said female terminal also being provided with a resilient tongue piece for supporting the inserted male terminal from below;

wherein said male terminal includes locally raised potions arranged on an upper surface of said rod-shaped electrical connection part, said locally raised portions being brought into contact with said plane upper surface when said male terminal is inserted into said female terminal; and wherein said rod-shaped electrical connection part of said male terminal is formed so as to describe arcs in cross section, and wherein respective apexes of said arcs constitute respective ones of said raised portions.

2. A terminal structure as claimed in claim 1, wherein said resilient tongue piece has an upper surface which has a protrusion provided thereon, and wherein said protrusion is brought into contact with said male terminal when said male terminal is inserted into said female terminal.

3. A terminal structure as claimed in claim 1, wherein said rod-shaped electrical connection part is formed in such a tight manner that clearance is not produced therein.

4. A terminal structure as claimed in claim 1, wherein said rod-shaped electrical connection part is formed so as to leave an interior space therein.

5. A terminal structure as claimed in claim 1, wherein said plane upper surface comprises a contiguous plane surface.

6. A terminal structure as claimed in claim 1, wherein said plane upper surface comprises a continuous, uninterrupted plane surface.

7. A terminal structure as claimed in claim 1, wherein said resilient tongue piece elastically supports said male terminal when said male terminal is inserted into said female terminal.

8. A terminal structure as claimed in claim 1, wherein said resilient tongue piece comprises a bent portion of a lower surface of said female terminal.

9. A terminal structure, comprising:

a male terminal formed by folding a piece of plate material, said male terminal having a rod-shaped electrical connection part formed on an end thereof; and a female terminal into which said male terminal is inserted for an electrical connection therebetween, said female terminal comprising an upper plane surface of plate material and a lower surface of plate material, said lower surface of plate material being folded to form a resilient tongue piece for supporting the inserted male terminal from below;

wherein said male terminal includes locally raised portions arranged on an upper surface of said rod-shaped electrical connection part, said locally raised portions being brought into contact with said plane upper surface of said female terminal when said male terminal is inserted into said female terminal; and wherein said rod-shaped electrical connection part is formed in such a tight manner that clearance is not produced therein.

10. A terminal structure as claimed in claim 9, wherein said resilient tongue piece has an upper surface which has a protrusion provided thereon, and wherein said protrusion is brought into contact with said male terminal when said male terminal is inserted into said female terminal.

11. A terminal structure as claimed in claim 9, wherein said rod-shaped electrical connection part of said male terminal is formed so as to describe arcs in cross-section, and wherein respective apexes of said arcs constitute respective ones of said raised portions.

12. A terminal structure as claimed in claim 9, wherein said plane upper surface comprises a contiguous plane surface.

13. A terminal structure as claimed in claim 9, wherein said plane upper surface comprises a continuous, uninterrupted plane surface.

14. A terminal structure as claimed in claim 9, wherein said resilient tongue piece elastically supports said male terminal when said male terminal is inserted into said female terminal.

15. A terminal structure as claimed in claim 9, wherein said lower surface of plate material is folded so that said resident tongue piece extends in a first direction, and said resilient tongue piece has an end portion which is further folded so that said end portion extends in a second direction opposite to said first direction.

16. A terminal structure as claimed in claim 15, wherein said first direction comprises a direction of insertion of said male terminal into said female terminal.

17. A terminal structure, comprising;

a male terminal formed by folding a piece of plate material, said male terminal having a rod-shaped electrical connection part formed on an end thereof; and a female terminal into which said male terminal is inserted for an electrical connection therebetween, said female terminal comprising an upper plane surface of plate material and a lower surface of plate material, said lower surface of plate material being folded to form a resilient tongue piece for supporting the inserted male terminal from below;

wherein said male terminal includes locally raised portions arranged on an upper surface of said rod-shaped electrical connection part, said locally raised portion being brought into contact with said plane upper surface of said female terminal when said male terminal is inserted into said female terminal; and wherein said rod-shaped electrical connection part is formed so as to leave an interior space therein.

18. A terminal structure as claimed in claim 17, wherein said resilient tongue piece has an upper surface which has a protrusion provided thereon, and wherein said protrusion is brought into contact with said male terminal when said male terminal is inserted into said female terminal.

19. A terminal structure as claimed in claim 17, wherein said rod-shaped electrical connection part of said male terminal is formed so as to describe arcs in cross-section, and wherein respective apexes of said arcs constitute respective ones of said raised portions.

20. A terminal structure as claimed in claim 17, wherein said plane upper surface comprises a contiguous plane surface.

21. A terminal structure as claimed in claim 17, wherein said plane upper surface comprises a continuous, uninterrupted plane surface.

22. A terminal structure as claimed in claim 17, wherein said resilient tongue piece elastically supports said male terminal when said male terminal is inserted into said female terminal.

23. A terminal structure as claimed in claim 17, wherein said lower surface of plate material is folded so that said resilient tongue piece extends in a first direction, and said resilient tongue piece has an end portion which is further folded so that said end portion extends in a second direction opposite to said first direction.

24. A terminal structure as claimed in claim 23, wherein said first direction comprises a direction of insertion of said male terminal into said female terminal.

* * * * *